US009031488B2

(12) United States Patent
Kimura

(10) Patent No.: US 9,031,488 B2
(45) Date of Patent: May 12, 2015

(54) FIXING MEMBER, FIXING DEVICE, AND IMAGE FORMING APPARATUS

(71) Applicant: Fuji Xerox Co., Ltd., Tokyo (JP)

(72) Inventor: Jun Kimura, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/968,808

(22) Filed: Aug. 16, 2013

(65) Prior Publication Data

US 2014/0205335 A1 Jul. 24, 2014

(30) Foreign Application Priority Data

Jan. 24, 2013 (JP) ..... 2013-011450

(51) Int. Cl.
*G03G 15/20* (2006.01)

(52) U.S. Cl.
CPC ..... *G03G 15/2053* (2013.01)

(58) Field of Classification Search
CPC ..... G03G 15/2053; G03G 15/206; G03G 2215/2061; G03G 2215/2064
USPC ..... 399/328, 331, 333
See application file for complete search history.

(56) References Cited

U.S. PATENT DOCUMENTS 5,253,026 A * 10/1993 Tamary ..... 399/331
5,455,077 A * 10/1995 Yamamoto et al. ..... 427/425
2011/0176844 A1 7/2011 Kimura et al.

FOREIGN PATENT DOCUMENTS

JP A-2004-233392 8/2004
JP A-2005-70272 3/2005

* cited by examiner

*Primary Examiner* — Gregory H Curran
(74) *Attorney, Agent, or Firm* — Oliff PLC

(57) ABSTRACT

A fixing member includes a base member having a substantially cylindrical surface; an elastic layer provided around the substantially cylindrical surface and having, at each axial end thereof, a sloping surface that slopes such that an outside diameter of the elastic layer is gradually reduced toward an outer side in an axial direction; and a surface layer joined to an outer circumferential surface of the elastic layer and a portion of the sloping surface and having a higher modulus of elasticity than the elastic layer, each axial end of the surface layer being free of restraint by the base member.

7 Claims, 9 Drawing Sheets

FIG. 8

| SAMPLE | RESULTS OF DURABILITY EVALUATION |
|---|---|
| WORKING EXAMPLE 1 | NO BREAKAGE OCCURS FOR 200 HOURS |
| WORKING EXAMPLE 2 | NO BREAKAGE OCCURS FOR 200 HOURS |
| WORKING EXAMPLE 3 | NO BREAKAGE OCCURS FOR 200 HOURS |
| WORKING EXAMPLE 4 | NO BREAKAGE OCCURS FOR 200 HOURS BUT CRACKS ARE IDENTIFIED IN EXPOSED PORTION OF SLOPING END FACET |
| COMPARATIVE EXAMPLE 1 | BREAKAGE OCCURS IN 32 HOURS IN END OF ELASTIC LAYER AND FROM INTERFACE BETWEEN ELASTIC LAYER AND CORED BAR |
| COMPARATIVE EXAMPLE 2 | BREAKAGE OCCURS IN 25 HOURS IN END OF ELASTIC LAYER AND FROM INTERFACE BETWEEN ELASTIC LAYER AND CORED BAR |
| COMPARATIVE EXAMPLE 3 | BREAKAGE OCCURS IN 22 HOURS IN END OF ELASTIC LAYER AND FROM INTERFACE BETWEEN ELASTIC LAYER AND CORED BAR |
| COMPARATIVE EXAMPLE 4 | PART OF OVERHANGING PORTION IS BROKEN IN 140 HOURS, SLOPING END FACET OF ELASTIC LAYER COMES INTO CONTACT WITH HARD ROLLER AT POSITION OF BREAKAGE, AND BREAKAGE OCCURS IN SLOPING END FACET OF ELASTIC LAYER IN 162 HOURS |

FIXING MEMBER, FIXING DEVICE, AND IMAGE FORMING APPARATUS

CROSS-REFERENCE TO RELATED APPLICATIONS

This application is based on and claims priority under 35 USC 119 from Japanese Patent Application No. 2013-011450 filed Jan. 24, 2013.

BACKGROUND

Technical Field

The present invention relates to a fixing member, a fixing device, and an image forming apparatus.

SUMMARY

According to an aspect of the invention, there is provided a fixing member including a base member having a substantially cylindrical surface; an elastic layer provided around the substantially cylindrical surface and having, at each axial end thereof, a sloping surface that slopes such that an outside diameter of the elastic layer is gradually reduced toward an outer side in an axial direction; and a surface layer joined to an outer circumferential surface of the elastic layer and a portion of the sloping surface and having a higher modulus of elasticity than the elastic layer, each axial end of the surface layer being free of restraint by the base member.

BRIEF DESCRIPTION OF THE DRAWINGS

An exemplary embodiment of the present invention will be described in detail based on the following figures, wherein:

FIG. 8 is a table that summarizes the results of an evaluation of working examples and comparative examples.

DETAILED DESCRIPTION

Configuration of Image Forming Apparatus 10

Figure 1:
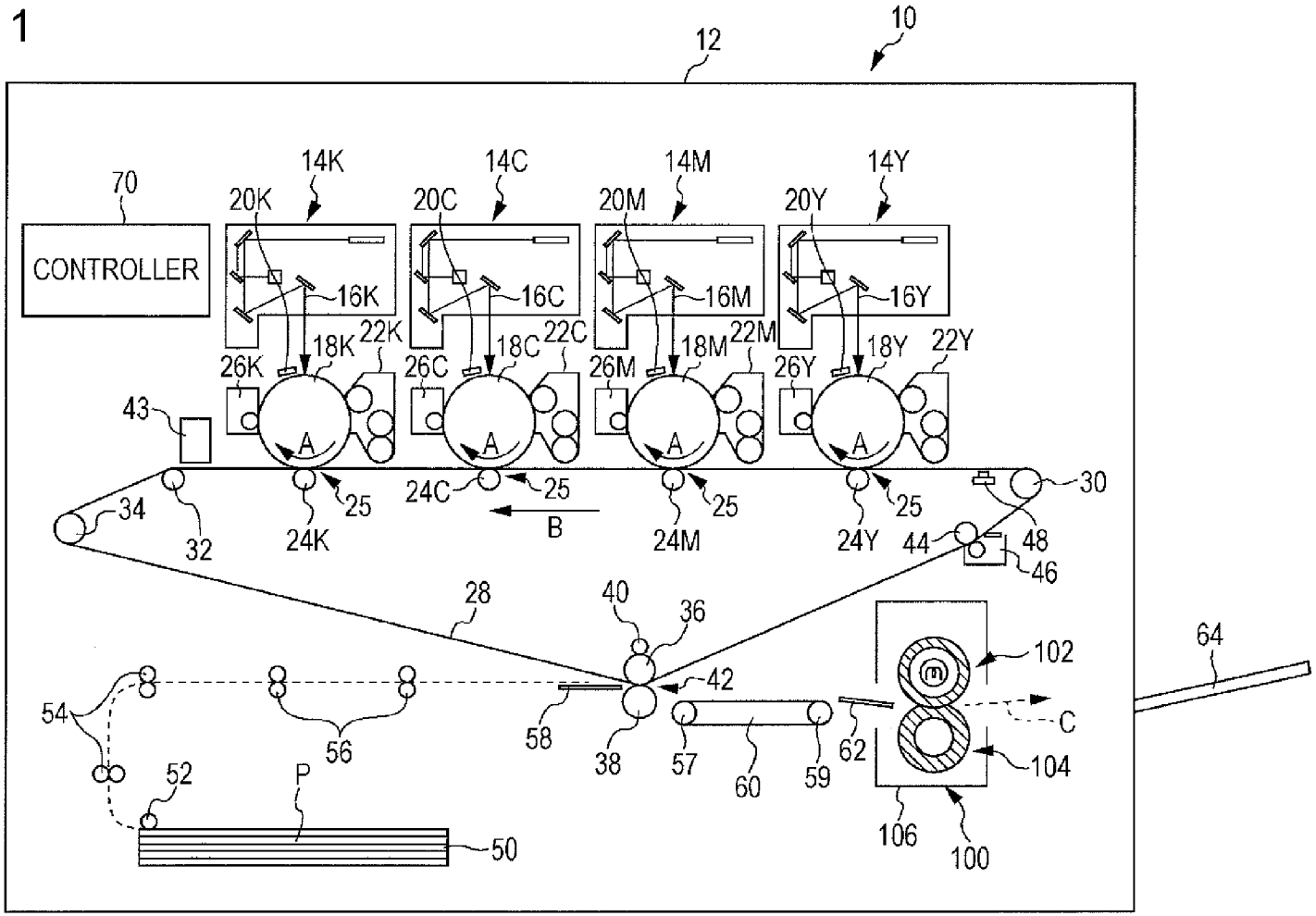
FIG. 1 is a schematic diagram of an image forming apparatus according to the exemplary embodiment.

A configuration of an image forming apparatus 10 according to an exemplary embodiment of the present invention will first be described. FIG. 1 is a schematic diagram of the image forming apparatus 10 according to the exemplary embodiment.

Referring to FIG. 1, the image forming apparatus 10 includes a housing 12 that forms the body of the image forming apparatus 10 and in which the following are provided: optical scanning devices 14Y, 14M, 14C, and 14K that emit respective light beams 16 corresponding to respective colors of yellow (Y), magenta (M), cyan (C), and black (K); and a controller 70 provided at a position adjacent to the optical scanning device 14K (in FIG. 1, on the left side of the optical scanning device 14K). The controller 70 controls operations of elements included in the image forming apparatus 10. Hereinafter, if such elements need to be distinguished from one another by Y, M, C, and K, any of reference characters Y, M, C, and K are given as suffixes to reference numerals that are given to those elements. If such elements have the same configuration and do not need to be distinguished from one another by Y, M, C, and K, the reference characters Y, M, C, and K as suffixes are omitted.

The optical scanning devices 14 each perform scanning by moving a light beam, which is emitted from a light source, back and forth by using a rotating polygonal mirror (a polygon mirror, not illustrated). The light beam is reflected by plural optical components such as reflecting mirrors. Consequently, the optical scanning devices 14 emit the light beams 16 corresponding to the respective colors. Photoconductors 18 are provided below the respective optical scanning devices 14.

The photoconductors 18 are each rotated in a direction of arrow A (clockwise in FIG. 1) by a driving unit (not illustrated) that includes a motor and a gear. The light beams 16 emitted from the optical scanning devices 14 are guided to the respective photoconductors 18. Charging devices 20 that charge the surfaces of the respective photoconductors 18 are each provided at a position facing the surface (outer circumferential surface) of a corresponding one of the photoconductors 18 and on the upstream side of a position of application of a corresponding one of the light beams 16 in the direction of rotation (the direction of arrow A) of the photoconductor 18.

Developing devices 22 are provided on the downstream side of the respective charging devices 20 in the direction of rotation of the photoconductors 18. The developing devices 22 develop electrostatic latent images on the respective photoconductors 18 with toners (developers) having the above respective colors. The electrostatic latent images are formed through the charging of the photoconductors 18 by the charging devices 20 and the application of the light beams 16 to the photoconductors 18 by the optical scanning devices 14. An intermediate transfer belt 28 resides on the downstream side of the developing devices 22 in the direction of rotation of the photoconductors 18. Toner images obtained through the development performed by the developing devices 22 are first-transferred to the intermediate transfer belt 28. The intermediate transfer belt 28 is, for example, a film-type endless belt composed of resin such as polyimide or polyamide to which an adequate amount of antistatic agent such as carbon black is added.

First transfer rollers 24 are provided at positions where the respective photoconductors 18 face the intermediate transfer belt 28 and on the inner side of the intermediate transfer belt 28. The first transfer rollers 24 transfer the toner images on the respective photoconductors 18 to the intermediate transfer belt 28. The first transfer rollers 24 provide respective first transfer portions 25 where the toner images are first-transferred from the respective photoconductors 18 to the intermediate transfer belt 28.

The first transfer rollers 24 each include a shaft (not illustrated) and a sponge layer as an elastic layer that is firmly bonded around the shaft. The shaft is, for example, a round columnar bar made of metal such as iron or stainless steel. The sponge layer is made of, for example, rubber containing carbon black (a conductive agent).

The first transfer rollers 24 are provided across the intermediate transfer belt 28 from the respective photoconductors 18. Voltage applying devices (not illustrated) apply voltages of a polarity that is opposite to the charging polarity of the toners to the respective first transfer rollers 24. Hence, the toner images on the respective photoconductors 18Y, 18M, 18C, and 18K are sequentially electrostatically attracted to the intermediate transfer belt 28, whereby the toner images are superposed one on top of another on the intermediate transfer belt 28. Cleaners 26 that remove residual toners from the respective photoconductors 18 after the first transfer are provided on the downstream side of the respective first transfer rollers 24 in the direction of rotation of the photoconductors 18.

A driving roller 30 and a supporting roller 32 are provided on the inner side of the intermediate transfer belt 28. The driving roller 30 is driven to rotate by a motor (not illustrated) and causes the intermediate transfer belt 28 to rotate. The supporting roller 32 supports the intermediate transfer belt 28 such that the intermediate transfer belt 28 extends substantially linearly in a direction in which the photoconductors 18Y, 18M, 18C, and 18K are arranged. In such a configuration, the intermediate transfer belt 28 rotates in a direction of arrow B.

An assist roller 34 is also provided on the inner side of the intermediate transfer belt 28. The assist roller 34 applies a tension to the intermediate transfer belt 28 and prevents meandering of the intermediate transfer belt 28. A second transfer portion 42 as an exemplary transfer portion is provided on the downstream side of the assist roller 34 in the direction of rotation of the intermediate transfer belt 28. The second transfer portion 42 transfers the superposition of the toner images on the intermediate transfer belt 28 to a recording medium sheet P as an exemplary recording medium.

The second transfer portion 42 is provided by a combination of a second transfer roller 38 and a supporting roller 36. The second transfer roller 38 is provided on a side of the intermediate transfer belt 28 on which the superposition of the toner images are carried. The supporting roller 36 is provided on the inner side of the intermediate transfer belt 28. The second transfer roller 38 includes the same layers as the first transfer rollers 24 and is made of the same material as the first transfer roller 24. The second transfer roller 38 faces the supporting roller 36 such that the intermediate transfer belt 28 is held between the second transfer roller 38 and the supporting roller 36.

The supporting roller 36 functions as a counter electrode for the second transfer roller 38. A second transfer bias is applied to the supporting roller 36 via a power feeding roller 40 made of metal and provided in contact with the supporting roller 36. The second transfer roller 38 is grounded. While the second transfer bias is applied across the second transfer roller 38 and the supporting roller 36, the superposition of the toner images on the intermediate transfer belt 28 is second-transferred to the recording medium sheet P that is transported to the second transfer portion 42.

An intermediate-transfer-belt cleaner 46 is provided on the downstream side of the second transfer portion 42 in the direction of rotation of the intermediate transfer belt 28. The intermediate-transfer-belt cleaner 46 removes residual toners and paper lint from the intermediate transfer belt 28 after the second transfer. The intermediate-transfer-belt cleaner 46 is movable to and away from the intermediate transfer belt 28. A supporting roller 44 is provided on the inner side of the intermediate transfer belt 28 and across from the intermediate-transfer-belt cleaner 46. A position sensor 48 is provided on the upstream side of the first transfer roller 24Y in the direction of rotation of the intermediate transfer belt 28 and on the inner side of the intermediate transfer belt 28. The position sensor 48 generates reference signals that notify the timing of image formation for the respective toners.

The position sensor 48 detects light reflected from detection marks (not illustrated) provided on the inner side of the intermediate transfer belt 28 and generates the reference signals. On the basis of the reference signals, the controller 70 activates relevant elements included in the image forming apparatus 10, whereby image formation is started. An image density sensor 43 that adjusts image quality is provided on the downstream side of the first transfer roller 24K in the direction of rotation of the intermediate transfer belt 28 and on the outer side of the intermediate transfer belt 28.

A paper storage 50 that stores recording medium sheets P is provided at a lower part of the housing 12. A feed roller 52 that feeds out and transports each of the recording medium sheets P at a preset timing is provided at one end of the paper storage 50 (on a side of the paper storage 50 from which each recording medium sheet P is fed). Plural pairs of transport rollers 54 and 56 are provided above the feed roller 52. The pairs of transport rollers 54 and 56 are each driven to rotate by a driving unit (not illustrated) that includes a motor and a gear and transport the recording medium sheet P that has been fed thereto by the feed roller 52 toward the second transfer portion 42. A transfer member 58 that sends the recording medium sheet P into the second transfer portion 42 is provided on the downstream side of the pairs of transport rollers 56 in the direction of transport of the recording medium sheet P.

A transport belt 60 that transports the recording medium sheet P having undergone the second transfer of the superposition of the toner images toward a fixing device 100 to be described below is provided on a side of the second transfer portion 42 toward which the recording medium sheet P is sent. The transport belt 60 is rotatably provided with a supporting roller 57, a driving roller 59, and a driving unit (not illustrated) that includes a motor and a gear. A guide 62 that guides the recording medium sheet P to the fixing device 100 is provided on the entrance side of the fixing device 100. A paper stacking portion 64 is provided on the exit side of the fixing device 100. The paper stacking portion 64 is secured to the housing 12 of the image forming apparatus 10.

Image Forming Operation

An image forming operation performed by the image forming apparatus 10 in which an image is formed on the recording medium sheet P will now be described.

Image data that has been output from an image reading apparatus or a personal computer (not illustrated) is processed by an image processing apparatus (not illustrated). The image data thus processed is converted into pieces of color gradation data for the four respective colors of Y, M, C, and K. The pieces of color gradation data are output to the respective optical scanning devices 14Y, 14M, 14C, and 14K.

The optical scanning devices 14Y, 14M, 14C, and 14K apply the light beams 16Y, 16M, 16C, and 16K to the photoconductors 18Y, 18M, 18C, and 18K, respectively, in accordance with the pieces of color gradation data that have been input thereto. The surfaces of the photoconductors 18Y, 18M, 18C, and 18K have been charged by the respective charging devices 20Y, 20M, 20C, and 20K in advance. Hence, when the surfaces of the photoconductors 18Y, 18M, 18C, and 18K are exposed to the respective light beams 16Y, 16M, 16C, and 16K, electrostatic latent images are formed thereon. The electrostatic latent images thus formed are developed into toner images in the respective colors of Y, M, C, and K by the respective developing devices 22Y, 22M, 22C, and 22K.

Subsequently, the toner images thus formed on the photoconductors 18Y, 18M, 18C, and 18K are transferred to the intermediate transfer belt 28 at the respective first transfer portions 25 in the following manner. The first transfer rollers 24Y, 24M, 24C, and 24K apply voltages (first transfer biases) of a polarity that is opposite to the charging polarity of the toners (the negative polarity, for example) to the intermediate transfer belt 28, and the toner images are sequentially superposed one on top of another on the intermediate transfer belt 28. The superposition of the toner images is transported to the second transfer portion 42 by the intermediate transfer belt 28.

Meanwhile, the feed roller 52 rotates in accordance with the timing of the transportation of the superposition of the toner images to the second transfer portion 42, whereby a recording medium sheet P is fed out of the paper storage 50. The recording medium sheet P thus fed out by the feed roller 52 is transported by the pairs of transport rollers 54 and 56, advances over the transfer member 58, and reaches the second transfer portion 42. Before the recording medium sheet P reaches the second transfer portion 42, the transportation of the recording medium sheet P is stopped temporarily. A registration roller (not illustrated) rotates in accordance with the timing of rotation of the intermediate transfer belt 28 carrying the superposition of the toner images. Thus, the recording medium sheet P and the superposition of the toner images are registered with respect to each other.

At the second transfer portion 42, the second transfer roller 38 is pressed against the supporting roller 36 with the intermediate transfer belt 28 interposed therebetween. The recording medium sheet P that has been transported to the second transfer portion 42 in accordance with the timing of transportation of the superposition of the toner images is nipped between the intermediate transfer belt 28 and the second transfer roller 38. Furthermore, a second transfer bias is applied from the power feeding roller 40 to the supporting roller 36, whereby a transfer electric field is produced. The superposition of the toner images that is yet to be fixed on the intermediate transfer belt 28 is pressed by the second transfer roller 38 and the supporting roller 36, whereby the entirety of the superposition of the toner images is electrostatically transferred to the recording medium sheet P.

Subsequently, the recording medium sheet P having the superposition of the toner images transferred thereto is released from the intermediate transfer belt 28, advances over the transport belt 60, and is transported to the fixing device 100. The superposition of the toner images that is yet to be fixed on the recording medium sheet P that has been transported to the fixing device 100 is heated and pressed at a contact part N (see FIG. 2) provided in the fixing device 100, thereby being fixed on the recording medium sheet P. The recording medium sheet P that has undergone the fixing is discharged in a direction of arrow C and is stacked on the paper stacking portion 64. After the superposition of the toner images has been transferred to the recording medium sheet P, residual toners on the intermediate transfer belt 28 are transported to the intermediate-transfer-belt cleaner 46 with the rotation of the intermediate transfer belt 28, and are removed from the intermediate transfer belt 28. Thus, the image forming apparatus 10 forms an image.

Configuration of Fixing Device 100

Figure 2:
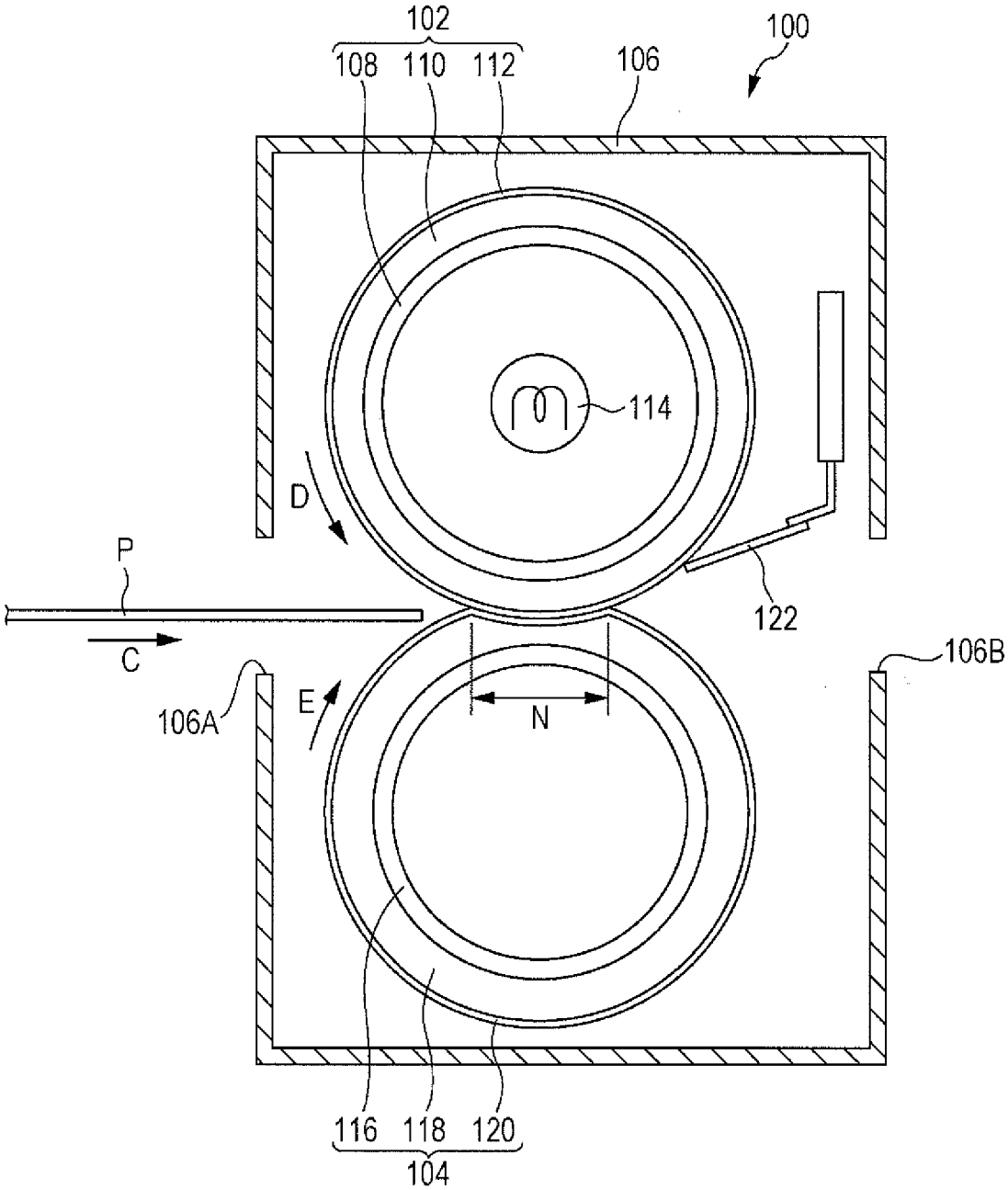
FIG. 2 is a schematic diagram of a fixing device according to the exemplary embodiment.

A configuration of the fixing device 100 will now be described. FIG. 2 is a schematic diagram of the fixing device 100.

Referring to FIG. 2, the fixing device 100 includes a housing 106 that has an opening 106A through which the recording medium sheet P enters the fixing device 100 and an opening 106B through which the recording medium sheet P is discharged from the fixing device 100. A fixing roller 102 (an exemplary heating member) that is supported in such a manner as to be rotatable in a direction of arrow D (counterclockwise in FIG. 2) is provided on the upper side in the housing 106. A pressure roller 104 (an exemplary fixing member or an exemplary pressing member) that is supported in such a manner as to be rotatable in a direction of arrow E (clockwise in FIG. 2) is provided on the lower side in the housing 106. The axes of the fixing roller 102 and the pressure roller 104 are parallel to each other. The outer circumferential surfaces of the fixing roller 102 and the pressure roller 104 are in contact with (pressed against) each other, whereby the contact part N (a nip) is formed.

The fixing roller 102 includes a cored bar 108, an elastic layer 110, and a surface layer 112 that are provided in that order from the inner circumferential side thereof toward the outer circumferential side thereof. In an exemplary configuration, the cored bar 108 is a cylindrical member made of aluminum, the elastic layer 110 is made of silicone rubber, and the surface layer 112 is made of fluororesin. A halogen heater 114 that generates heat when powered by the controller 70 (see FIG. 1) is provided on the inner side of the cored bar 108. A plate-type releasing member 122 that releases the recording medium sheet P from the outer circumferential surface of the fixing roller 102 is provided at a position on a side of the contact part N from which the recording medium sheet P is discharged and near the outer circumferential surface of the fixing roller 102.

The pressure roller 104 includes a cored bar 116 as an exemplary base member having a cylindrical or substantially cylindrical surface, an elastic layer 118, and a surface layer 120 that are provided in that order from the inner circumferential side thereof toward the outer circumferential side thereof.

In an exemplary configuration, the cored bar 116 is a cylindrical or substantially cylindrical member made of aluminum. In another exemplary configuration, the cored bar 116 may be made of metal such as iron or stainless steel, or a non-metallic material. Examples of the non-metallic material include heat-resistant resins such as polyphenylene sulfide, polyimide, polyester, polyamide, and liquid crystal polymer; and materials strengthened by adding glass fibers and the like to any of the foregoing resins.

The elastic layer 118 is provided around the cylindrical or substantially cylindrical surface of the cored bar 116 and is joined (bonded) thereto. The elastic layer 118 is made of a material such as silicone rubber or fluororubber having a durometer hardness of A10 or higher and A50 or lower (based on JIS K6253). In the exemplary embodiment, the elastic layer 118 is made of silicone rubber.

The surface layer 120 is provided around the outer circumferential surface (a cylindrical or substantially cylindrical surface extending in the axial direction) of the elastic layer 118 and is joined (bonded) thereto. The surface layer 120 is made of a material such as fluororesin containing carbon. The material used for the surface layer 120 has a modulus of elasticity that is ten times or more higher than that of the material used for the elastic layer 118. The carbon contained in the surface layer 120 may be carbon black such as Ketjenblack or acetylene black. The surface layer 120 may further contain a conductive agent. Examples of such a conductive agent include metals such as aluminum and nickel, metal-oxide compounds such as tin oxide, and potassium titanate.

The surface layer 120 preferably has a volume resistance of 4 log Ωcm or higher and 10 log Ωcm or lower, or more preferably 4 log Ωcm or higher and 7 log Ωcm or lower. If the volume resistance of the surface layer 120 falls within the above range, the surface layer 120 is assuredly conductive. Consequently, problems due to static electricity do not tend to occur, and the pressure roller 104 has good durability. The volume resistance is measured by a double-ring-electrode method.

The elastic layer 118 has a thickness of, for example, 10 mm or larger and 15 mm or smaller. The surface layer 120 has a thickness of, for example, 50 μm or larger and 150 μm or smaller. The thickness of the elastic layer 118 is 10 mm or larger because, with an increase in the speed of the operation of the image forming apparatus 10, the contact part N needs to have a large width so that a required amount of heat to be applied to the toners is provided in a short time. Accordingly, the elastic layer 118 needs to be deformable by a large amount. To form the contact part N, the elastic layer 118 deforms by, for example, 10% to 20% in the radial direction.

Figure 3A:
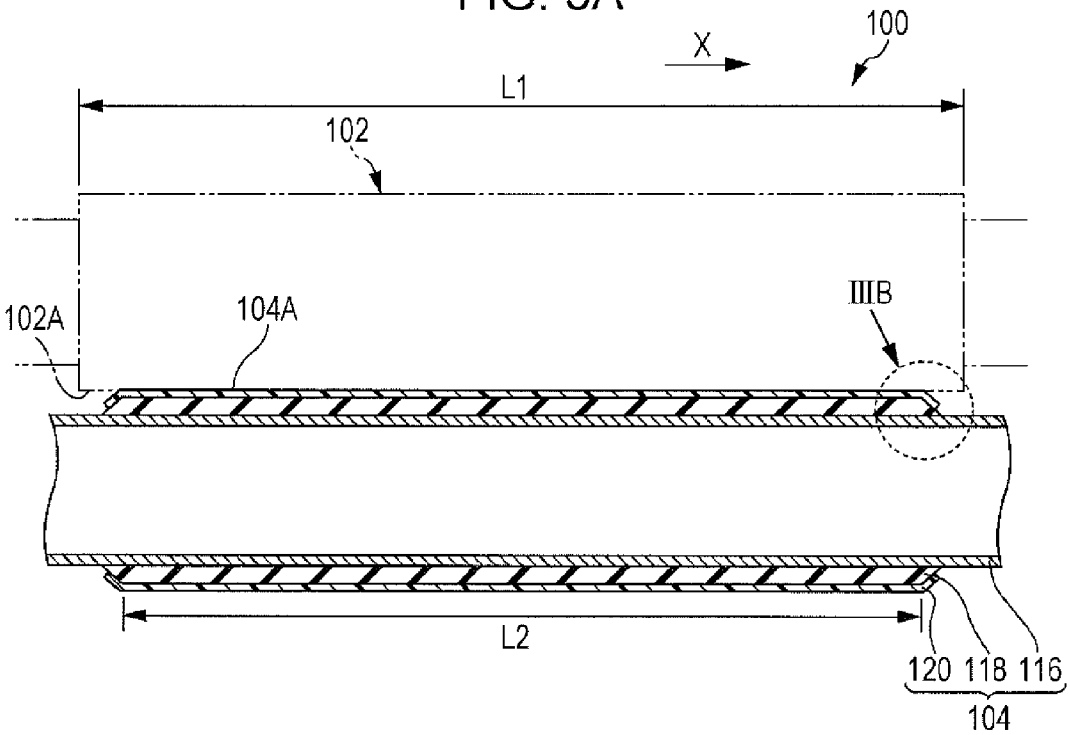
FIG. 3A is a sectional view of a pressure roller according to the exemplary embodiment.

FIG. 3A is a sectional view of the pressure roller 104 taken in the axial direction thereof (a direction of arrow X). In FIG. 3A, L1>L2 holds, where L1 denotes the axial length of an outer circumferential surface 102A (the outermost cylindrical surface) of the fixing roller 102 represented by dash-dot-dot lines, and L2 denotes the axial length of an outer circumferential surface 104A (the outermost cylindrical or substantially cylindrical surface) of the pressure roller 104 (the axial length of the outer surface of the surface layer 120 excluding two axial end portions thereof extending over sloping end facets 124 to be described below). Hence, axial end portions of the outer circumferential surface 102A (the outermost cylindrical surface) of the fixing roller 102 overhang the respective axial end portions of the outer circumferential surface 104A of the pressure roller 104 toward the outer side in the axial direction.

Figure 3B:
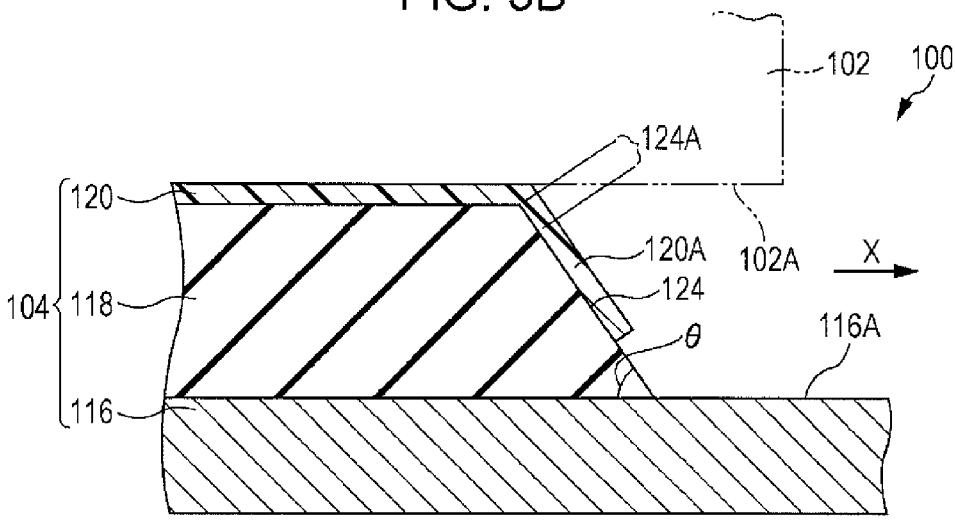
FIG. 3B is an enlarged view of sectional area IIIB illustrated in FIG. 3A.

FIG. 3B is an enlarged view of sectional area IIIB at one end of the pressure roller 104 illustrated in FIG. 3A. The elastic layer 118 has the sloping end facets 124 at two respective axial ends thereof. The sloping end facets 124 as exemplary sloping surfaces each slopes such that the outside diameter of the elastic layer 118 is gradually reduced toward the outer side in the axial direction (toward the right side in FIG. 3B). That is, each sloping end facet 124 slopes such that the axial length of the elastic layer 118 is larger on a side facing the cored bar 116 than on a side facing the surface layer 120. The angle of slope of the sloping end facet 124 with respect to an outer circumferential surface (cylindrical or substantially cylindrical surface) 116A of the cored bar 116 is θ (0°<θ<90°). The sloping end facet 124 referred to herein is a portion sloping under no load (in a state where the pressure roller 104 is not pressed against the fixing roller 102).

Axial end portions 120A of the surface layer 120 each extend over a portion of a corresponding one of the sloping end facets 124 of the elastic layer 118 and are each joined (bonded) thereto. Each axial end portion 120A of the surface layer 120 is spaced apart from the cored bar 116. That is, the axial end portion 120A of the surface layer 120 is not in contact with the cored bar 116. Therefore, the axial end portion 120A of the surface layer 120 is not restrained by the cored bar 116. Since the axial end portion 120A of the surface layer 120 is spaced apart from the cored bar 116, a portion of the sloping end facet 124 that is on the outer side (the right side in FIG. 3B) of the surface layer 120 in the axial direction is exposed.

The length (denoted by L4 in FIG. 7) of the portion of the surface layer 120 that is joined to the sloping end facet 124 (hereinafter referred to as the joined portion) in a direction along the sloping end facet 124 may be 10% or greater and 95% or smaller or about 10% or greater and about 95% or smaller of the length of the sloping end facet 124 (denoted by L3 in FIG. 7). If the length of the joined portion in the direction along the sloping end facet 124 exceeds 95% or about 95% of the length of the sloping end facet 124, the sloping end facet 124 of the elastic layer 118 may be prevented from deforming in such a manner as to swell out when the fixing roller 102 and the pressure roller 104 are pressed against each other and the elastic layer 118 of the pressure roller 104 is thus squashed. Consequently, the stress may concentrate on the interface between the elastic layer 118 and the cored bar 116, and the elastic layer 118 may be broken.

If the length of the joined portion in the direction along the sloping end facet 124 is smaller than 10% or about 10% of the length of the sloping end facet 124, an axially inner-side portion 124A of the sloping end facet 124 of the elastic layer 118 may deform in such a manner as to swell out toward the outer circumferential side (the upper side in FIG. 3B) when the fixing roller 102 and the pressure roller 104 are pressed against each other and the elastic layer 118 of the pressure roller 104 is thus squashed. Consequently, the axially inner-side portion 124A may come into contact with the outer circumferential surface 102A of the fixing roller 102, and the elastic layer 118 may be broken. That is, if the length of the joined portion in the direction along the sloping end facet 124 is 10% or greater or about 10% or greater of the length of the sloping end facet 124, the surface layer 120 is joined to a deformable portion of the sloping end facet 124 that tends to undergo elastic deformation toward a plane extending in the axial direction when the pressure roller 104 is pressed against the fixing roller 102. Specifically, supposing that the surface layer 120 is not joined to the sloping end facet 124, the term "deformable portion" refers to a portion of the sloping end facet 124 that comes into contact with the fixing roller 102 by undergoing elastic deformation when the pressure roller 104 is pressed against the fixing roller 102. For example, a portion 118A included in a configuration illustrated in FIG. 5B that is to be described below.

Function of Pressure Roller 104

A function of the pressure roller 104 will now be described.

First, as comparative embodiments to the exemplary embodiment, a function of a pressure roller 204 included in a fixing device 200 according to a first comparative embodiment and a function of a pressure roller 304 included in a fixing device 300 according to a second comparative embodiment will be described. Elements that are the same as those of the fixing device 100 according to the exemplary embodiment are denoted by corresponding ones of the reference numerals used in the exemplary embodiment, and description thereof is omitted.

Figure 4A:
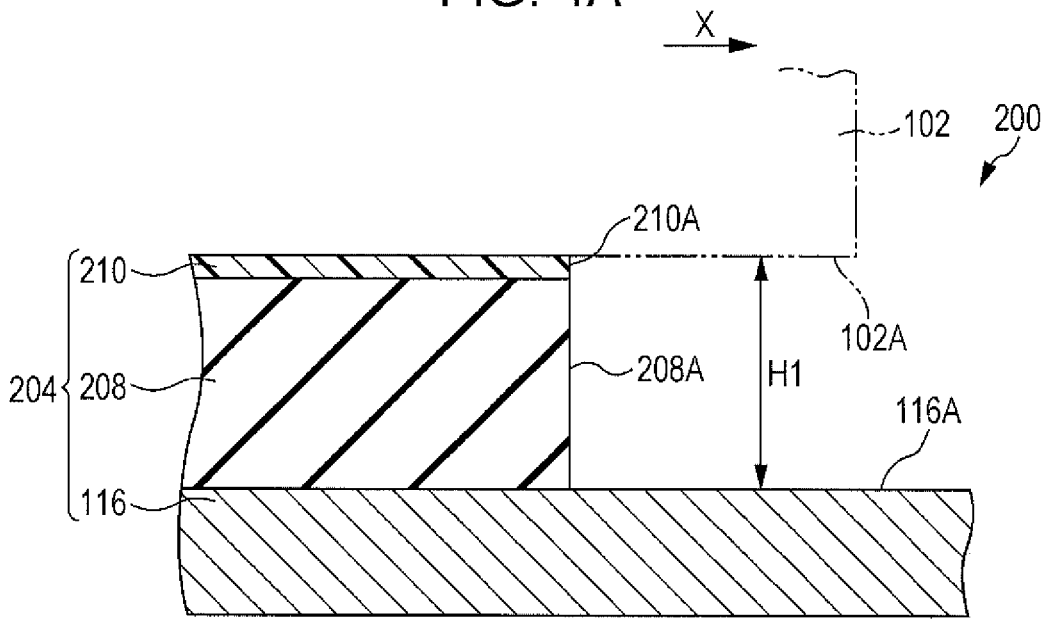
FIGS. 4A and 4B are sectional views illustrating how a pressure roller according to a first comparative embodiment deforms.

FIG. 4A is a sectional view illustrating one end of the pressure roller 204 included in the fixing device 200 according to the first comparative embodiment. The fixing device 200 includes the fixing roller 102 and the pressure roller 204. The pressure roller 204 includes the cored bar 116, an elastic layer 208 that is made of the same material and has the same thickness as the elastic layer 118 (see FIG. 2), and a surface layer 210 that is made of the same material as the surface layer 120 (see FIG. 2).

The elastic layer 208 and the surface layer 210 have respective end facets 208A and 210A extending in a direction perpendicular to the axial direction and residing at the same position in the axial direction. The elastic layer 208 and the surface layer 210 each have an axial length that is the same as the axial length L2 illustrated in FIG. 3A. The angles formed between the outer circumferential surface 116A of the cored bar 116 and the respective end facets 208A and 210A are both 90°. In a state where the pressure roller 204 is not pressed against the fixing roller 102, the outer circumferential surface 116A of the cored bar 116 and the outer circumferential surface of the surface layer 210 are at a distance H1 from each other in the direction perpendicular to the axial direction.

Figure 4B:
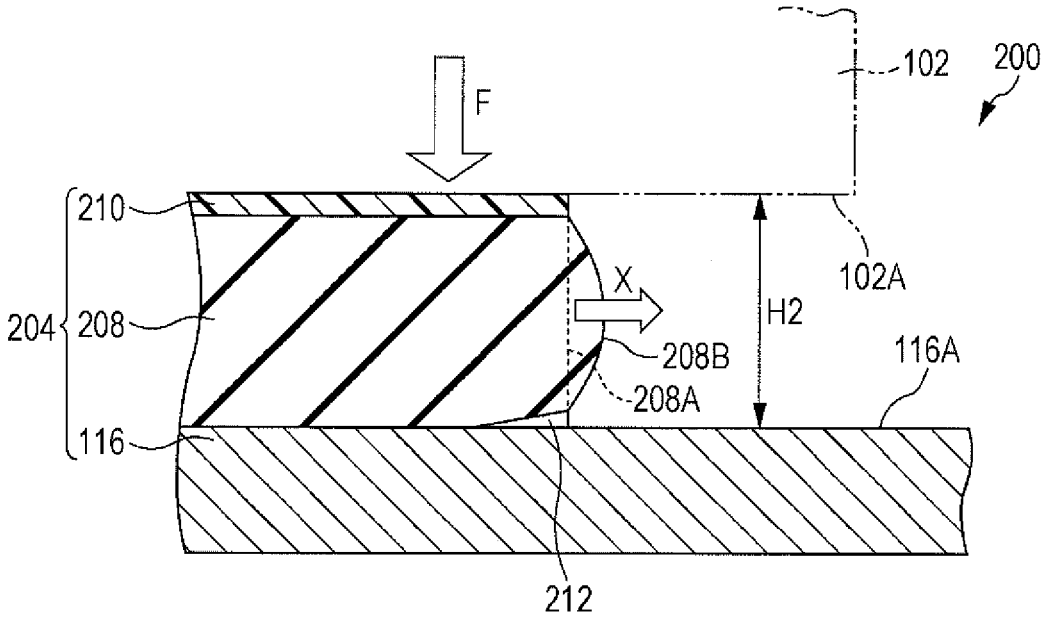

Referring to FIG. 4B, in the fixing device 200 according to the first comparative embodiment, when the fixing roller 102 and the pressure roller 204 are pressed against each other and a pressing force F acts in a direction intersecting the axial direction of the pressure roller 204, the elastic layer 208 is squashed and the distance from the outer circumferential surface 116A of the cored bar 116 to the outer circumferential surface of the surface layer 210 changes to a distance H2 (<H1).

The elastic layer 208 thus squashed is made of rubber and the volume thereof does not change. Therefore, a portion of the volume that has been squashed tends to project in the anteroposterior direction of the contact part N (see FIG. 2) (in the direction of arrow C in which the recording medium sheet P is transported). Nevertheless, since the surface layer 210 has a higher modulus of elasticity than the elastic layer 208, the portion of the elastic layer 208 that tends to project is restrained by the surface layer 210. Consequently, the elastic layer 208 tends to allow its deformation at its two axial ends. At each end of the elastic layer 208, a portion that is in contact with the cored bar 116 and a portion that is in contact with the surface layer 210 are each restrained (prevented from undergoing deformation) by a joining force. Therefore, the end facet 208A of the elastic layer 208 swells into an arc shape in sectional view, forming a curved end facet 208B. In this state, a large stress acting in the axial direction is applied to the elastic layer 208 because the original end facet 208A is a vertically extending surface and does not spread in the axial direction.

If the fixing device 200 in a state where the elastic layer 208 has swelled in the axial direction is used for a long time, the elastic layer 208 may be broken in any part thereof where the stress has concentrated. In the first comparative embodiment, since the elastic layer 208 and the cored bar 116 are joined to each other, a portion 212 of the elastic layer 208 at the axial end that is in contact with the cored bar 116 tends to be broken first.

Moreover, the end facets 208A and 210A of the elastic layer 208 and the surface layer 210 included in the pressure roller 204 are aligned with respect to each other. Even if the elastic layer 208 swells and comes to form the curved end facet 208B, the surface layer 210 does not substantially swell. Consequently, a portion of the curved end facet 208B may come into contact with the outer circumferential surface of the fixing roller 102. In such a situation, the probability that the elastic layer 208 may be broken increases because the elastic layer 208 is fragile with respect to friction.

Figure 5A:
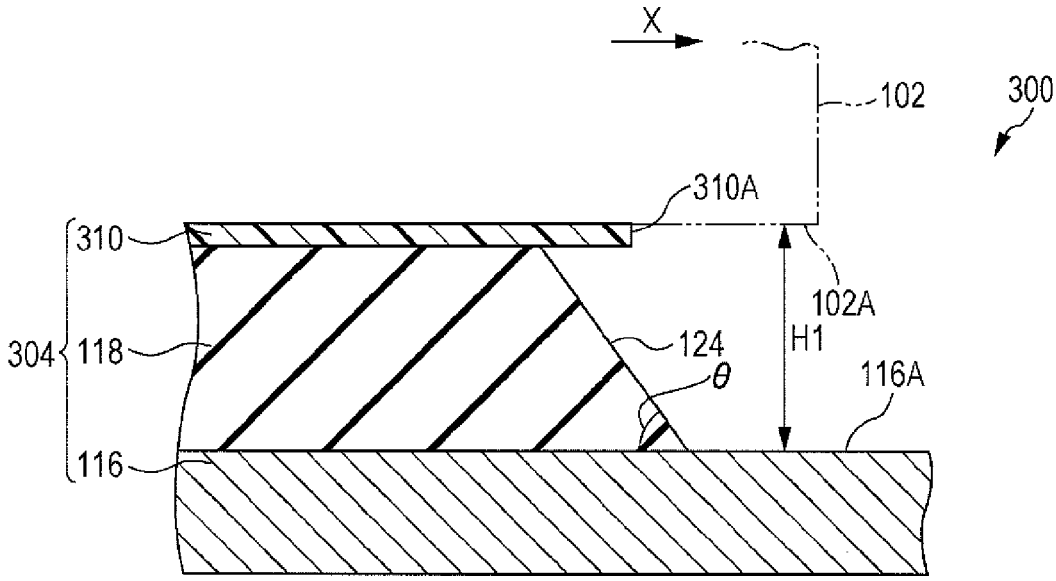
FIGS. 5A and 5B are sectional views illustrating how a pressure roller according to a second comparative embodiment deforms.

FIG. 5A is a sectional view illustrating one end of the pressure roller 304 included in the fixing device 300 according to the second comparative embodiment. The fixing device 300 includes the fixing roller 102 and the pressure roller 304. The pressure roller 304 includes the cored bar 116, the elastic layer 118, and a surface layer 310 that is made of the same material as the surface layer 120 (see FIG. 2).

The surface layer 310 has an overhanging portion 310A at each end thereof. The overhanging portion 310A overhangs the elastic layer 118 toward the outer side in the axial direction. The overhanging portion 310A is spaced apart from the sloping end facet 124 of the elastic layer 118. In a state where the pressure roller 304 is not pressed against the fixing roller 102, the outer circumferential surface 116A of the cored bar 116 and the outer circumferential surface of the surface layer 310 are at a distance H1 from each other in the direction perpendicular to the axial direction.

Figure 5B:
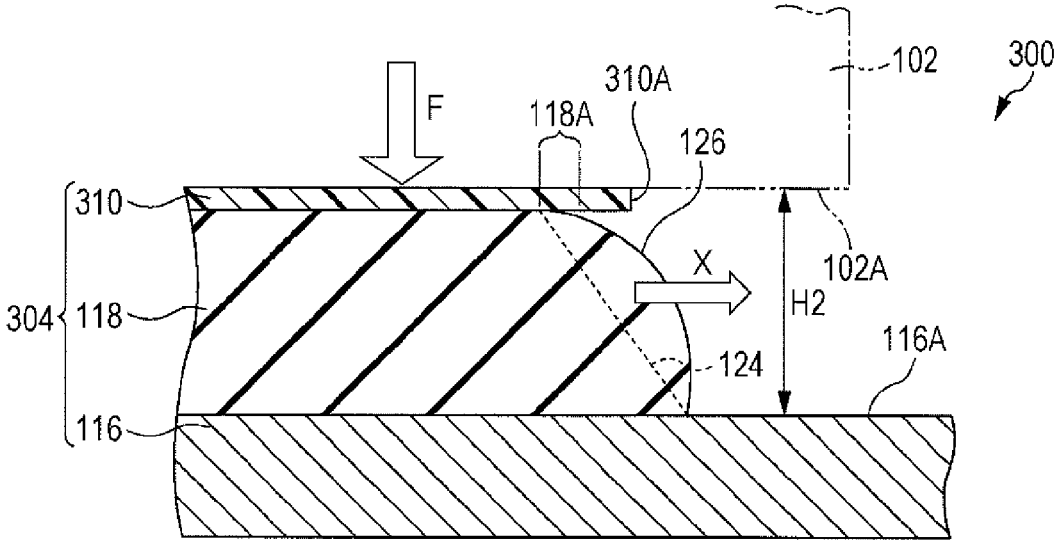

Referring to FIG. 5B, in the fixing device 300 according to the second comparative embodiment, when the fixing roller 102 and the pressure roller 304 are pressed against each other and a pressing force F acts in a direction intersecting the axial direction of the pressure roller 304, the elastic layer 118 is squashed and the distance from the outer circumferential surface 116A of the cored bar 116 to the outer circumferential surface of the surface layer 310 changes to a distance H2 (<H1).

The elastic layer 118 thus squashed by the pressing force F is made of rubber and the volume thereof does not change. Therefore, a portion of the volume that has been squashed tends to project in the anteroposterior direction of the contact part N (see FIG. 2) (in the direction of arrow C in which the recording medium sheet P is transported). Nevertheless, since the surface layer 310 has a higher modulus of elasticity than the elastic layer 118, the portion of the elastic layer 118 that tends to project is restrained by the surface layer 310. Consequently, the elastic layer 118 tends to allow its deformation at its two axial ends. At each end of the elastic layer 118, a portion that is in contact with the cored bar 116 and a portion that is in contact with the surface layer 310 are each restrained by a joining force. Therefore, the sloping end facet 124 of the elastic layer 118 swells into an arc shape in sectional view, forming a curved end facet 126.

Since the overhanging portion 310A of the surface layer 310 is not joined to the sloping end facet 124, friction may occur between the overhanging portion 310A and the curved end facet 126, which is originally the sloping end facet 124, because of relative displacement therebetween, resulting in wear of the elastic layer 118. Moreover, friction may occur between the overhanging portion 310A of the surface layer 310 and the outer circumferential surface 102A of the fixing roller 102, resulting in wear of the outer circumferential surface 102A of the fixing roller 102 or damage to the overhanging portion 310A of the surface layer 310. If the overhanging portion 310A is damaged, the sloping end facet 124 as the curved end facet 126 may be exposed and come into contact with the outer circumferential surface 102A of the fixing roller 102, resulting in breakage of the elastic layer 118.

Figure 6A:
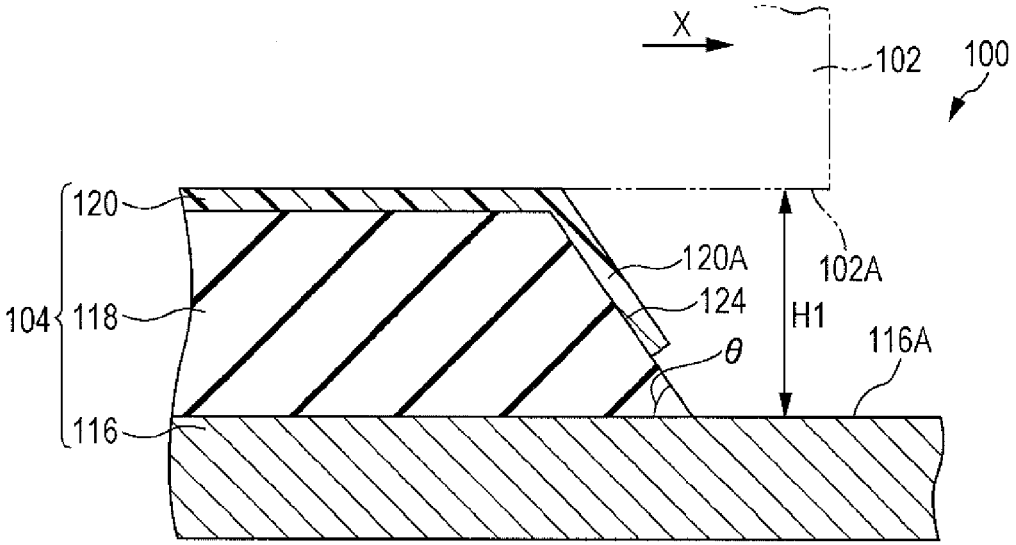
FIGS. 6A and 6B are sectional views illustrating how the pressure roller according to the exemplary embodiment deforms.

In contrast, referring to FIG. 6A illustrating the fixing device 100 according to the exemplary embodiment, in a state where the pressure roller 104 is not pressed against the fixing roller 102, the outer circumferential surface 116A of the cored bar 116 and the outer circumferential surface of the surface layer 120 are at a distance H1 from each other in the direction perpendicular to the axial direction. Furthermore, since the sloping end facet 124 slopes at the sloping angle θ (see FIG. 3B), the sloping end facet 124 according to the exemplary embodiment has a larger surface area than the end facet 208A according to the first comparative embodiment (see FIG. 4A).

Figure 6B:
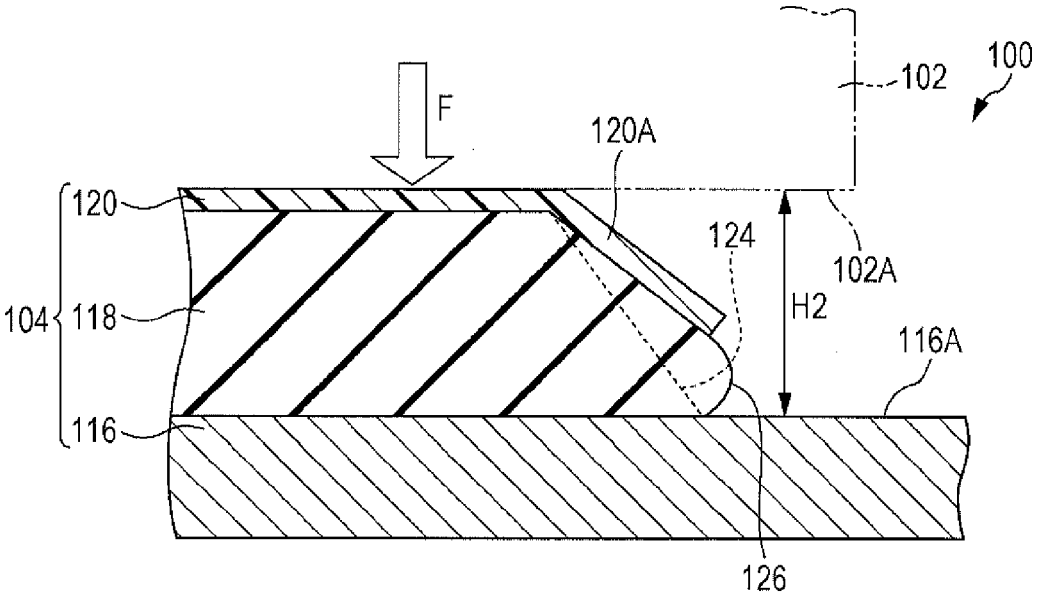

Referring to FIG. 6B illustrating the fixing device 100 according to the exemplary embodiment, when the fixing roller 102 and the pressure roller 104 are pressed against each other and a pressing force F acts in a direction intersecting the axial direction of the pressure roller 104, the elastic layer 118 is squashed and the distance from the outer circumferential surface 116A of the cored bar 116 to the outer circumferential surface of the surface layer 120 changes to a distance H2 (<H1).

The elastic layer 118 thus squashed by the pressing force F is made of rubber and the volume thereof does not change.

Therefore, a portion of the volume that has been squashed tends to project in the anteroposterior direction of the contact part N (see FIG. 2) (in the direction of arrow C in which the recording medium sheet P is transported). Nevertheless, since the surface layer 120 has a higher modulus of elasticity than the elastic layer 118, the portion of the elastic layer 118 that tends to project is restrained by the surface layer 120. Consequently, the elastic layer 118 tends to allow its deformation at its two axial ends. At each end of the elastic layer 118, a portion that is in contact with the cored bar 116 and a portion that is in contact with the surface layer 120 are each restrained by a joining force. Therefore, the sloping end facet 124 of the elastic layer 118 swells into an arc shape in sectional view, forming a curved end facet 126.

The sloping end facet 124 of the elastic layer 118 originally spreads in the axial direction and has a larger surface area than the end facet 208A according to the first comparative embodiment. Therefore, the axial end of the elastic layer 118 is deformable more freely than the axial end of the elastic layer 208 according to the first comparative embodiment (see FIG. 4B). Hence, the elastic layer 118 is easy to deform even if some portions thereof are restrained by the cored bar 116 and the surface layer 120. Accordingly, the elastic layer 118 does not tend to be subject to local concentration of a large stress.

In the pressure roller 104, the axial end portion 120A of the surface layer 120 is joined to the sloping end facet 124. Therefore, even if the sloping end facet 124 undergoes elastic deformation in such a manner as to swell toward the outer side in the radial direction when the pressure roller 104 is pressed against the fixing roller 102, the surface layer 120 resides between a portion of the sloping end facet 124 and the fixing roller 102. Accordingly, the portion of the sloping end facet 124 is prevented from coming into contact with the fixing roller 102. Moreover, the axial end portion 120A of the surface layer 120 is spaced apart from the cored bar 116. Therefore, the axial end portion 120A of the surface layer 120 does not hinder the deformation of the sloping end facet 124, and the concentration of stress does not tend to occur in the elastic layer 118.

In the exemplary embodiment, the axial end portion 120A of the surface layer 120 is joined to the sloping end facet 124 and therefore does not cause friction with respect to the elastic layer 118. Hence, the elastic layer 118 is not damaged by friction with the axial end portion 120A of the surface layer 120. Furthermore, unlike the overhanging portion 310A according to the second comparative embodiment that is separate from the elastic layer 118, the axial end portion 120A of the surface layer 120 that is joined to the sloping end facet 124 is difficult to damage even at a contact with the outer circumferential surface 102A of the fixing roller 102. Since the axial end portion 120A of the surface layer 120 is difficult to damage, the sloping end facet 124 is maintained to be covered. Hence, even if the sloping end facet 124 deforms into the curved end facet 126, the curved end facet 126 does not come into contact with the outer circumferential surface 102A of the fixing roller 102. Thus, the occurrence of breakage of the elastic layer 118 is suppressed.

Evaluation

Pressure rollers having different axial-end configurations are prepared (see Working Examples 1 to 4 and Comparative Examples 1 to 4 to be described below), and an evaluation of durability of the pressure rollers is conducted in which each of the pressure rollers and a hard roller having no elastic layer are pressed against each other with a predetermined load, and the rollers are rotated without the performance of the image forming operation.

Configuration of Hard Roller

Outside diameter: 100 mm

Material: Aluminum (with a thickness of 10 mm)

Figure 7:
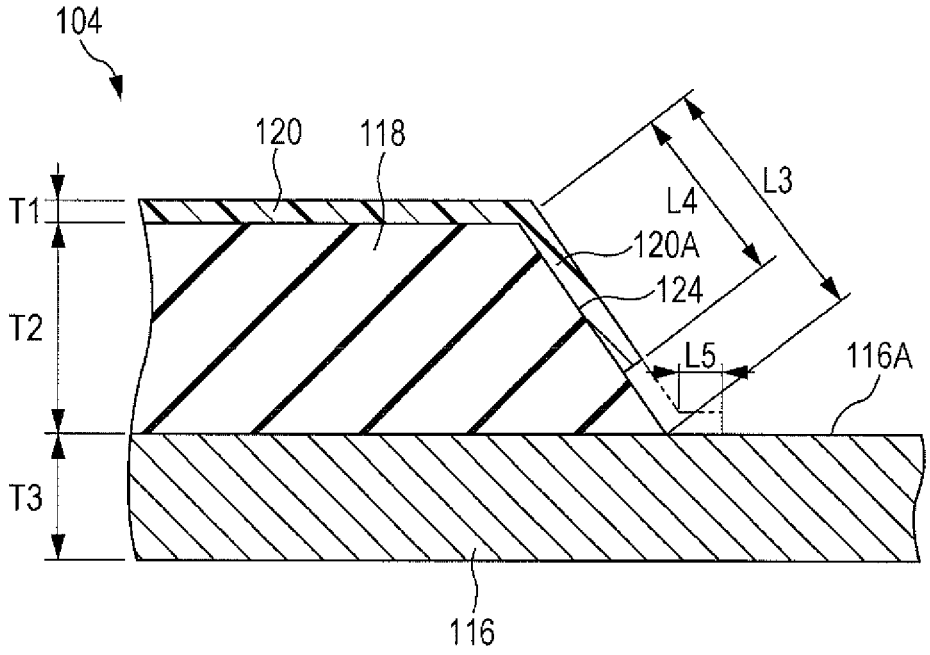
FIG. 7 is a sectional view illustrating part of the pressure roller according to the exemplary embodiment.

Basic Configuration of Pressure Roller (See FIG. 7)

Outside diameter: 100 mm

Surface layer 120 (210, 310): Perfluoroalkoxy fluoroplastic (PFA) tube (with a thickness T1 of 150 μm)

Elastic layer 118 (208): Silicone rubber (with a hardness of 35° according to JIS-A, and a thickness T2 of 10 mm)

Sloping angle θ of sloping end facet 124 with respect to outer circumferential surface 116A of cored bar 116: 45°

Configuration of end portion: See Working Examples 1 to 4 and Comparative Examples 1 to 4 below.

Cored bar 116: Aluminum (with a thickness T3 of 10 mm)

Conditions for Evaluation

Pressing load: 220 kgf (2156 N)

Width of contact part N (see FIG. 2): 18 mm

Drive: Hard roller is driven (pressure roller follows)

Temperature of hard roller: A thermocouple is brought into contact with the surface of the roller, and the surface temperature of the roller is controlled to be 120° C. by using a quartz lamp provided in the roller.

Temperature of pressure roller: No heat source is provided, and the roller is heated with the heat of the hard roller transmitted thereto at the contact part N (the surface temperature during the test is 105° C.)

Speed of rotation: 100 rpm

Working Example 1

The length (L3) of the sloping end facet 124 is 14 mm while the length (L4) of a portion of the surface layer 120 that is joined to the sloping end facet 124 in the direction along the sloping end facet 124 is 1.5 mm. That is, the length of the joined portion in the direction along the sloping end facet 124 is 10.7% of the length of the sloping end facet 124.

Working Example 2

The length (L3) of the sloping end facet 124 is 14 mm while the length (L4) of a portion of the surface layer 120 that is joined to the sloping end facet 124 in the direction along the sloping end facet 124 is 10 mm. That is, the length of the joined portion in the direction along the sloping end facet 124 is 71.4% of the length of the sloping end facet 124.

Working Example 3

The length (L3) of the sloping end facet 124 is 14 mm while the length (L4) of a portion of the surface layer 120 that is joined to the sloping end facet 124 in the direction along the sloping end facet 124 is 13 mm. That is, the length of the joined portion in the direction along the sloping end facet 124 is 92.8% of the length of the sloping end facet 124.

Working Example 4

The length (L3) of the sloping end facet 124 is 14 mm while the length (L4) of a portion of the surface layer 120 that is joined to the sloping end facet 124 in the direction along the sloping end facet 124 is 1 mm. That is, the length of the joined portion in the direction along the sloping end facet 124 is 7.1% of the length of the sloping end facet 124.

Comparative Example 1

The length (L3) of the sloping end facet 124 is 14 mm while the length (L4) of a portion of the surface layer 120 that is joined to the sloping end facet 124 in the direction along the sloping end facet 124 is 14 mm. That is, the length of the joined portion in the direction along the sloping end facet 124 is 100% of the length of the sloping end facet 124.

Comparative Example 2

The surface layer 120 extends beyond the sloping end facet 124 having a length (L3) of 14 mm and over a portion, having a length (L5) of 5 mm, of the outer circumferential surface of the cored bar 116. The surface layer 120 is joined to the sloping end facet 124 and the portion of the outer circumferential surface of the cored bar 116 (see the part represented by dash-dot-dot lines in FIG. 7).

Comparative Example 3

As illustrated in FIG. 4A, the elastic layer 208 does not include the sloping end facet 124 at each axial end, and the ends of the elastic layer 208 and the surface layer 210 are cut in the direction perpendicular to the axial direction.

Comparative Example 4

As illustrated in FIG. 5A, the surface layer 310 does not cover the sloping end facet 124 and includes the overhanging portion 310A that overhangs the axial end of the elastic layer 118 by 10 mm toward the outer side in the axial direction. The overhanging portion 310A is spaced apart from the sloping end facet 124.

The table in FIG. 8 summarizes the results of the evaluation of the pressure rollers according to Working Examples 1 to 4 and Comparative Examples 1 to 4. The results show the following. In Working Examples 1 to 3, no breakage occurs in the elastic layer 118 for 200 hours. In Working Example 4, no breakage occurs in the elastic layer 118 for 200 hours, but cracks due to scratches are identified in an exposed portion of the sloping end facet 124 of the elastic layer 118.

Meanwhile, breakage occurs in part of the axial end portion of the elastic layer 208 that is in contact with the cored bar 116 and from the interface between the elastic layer 208 and the cored bar 116 in 32 hours in Comparative Example 1, in 25 hours in Comparative Example 2, and in 22 hours in Comparative Example 3. In Comparative Example 4, part of the overhanging portion 310A of the surface layer 310 is broken in 140 hours, the sloping end facet 124 of the elastic layer 118 that faces the hard roller starts to come into contact with the hard roller at the position of breakage, and breakage occurs in the sloping end facet 124 of the elastic layer 118 in 162 hours.

The above results show that the occurrence of breakage in the sloping end facet 124 formed at the axial end of the elastic layer 118 is more suppressed in the pressure rollers according to Working Examples 1 to 4 than in the pressure rollers according to Comparative Examples 1 to 4.

MODIFICATIONS

The present invention is not limited to the above exemplary embodiment and may be modified as described below.

Figure 9A:
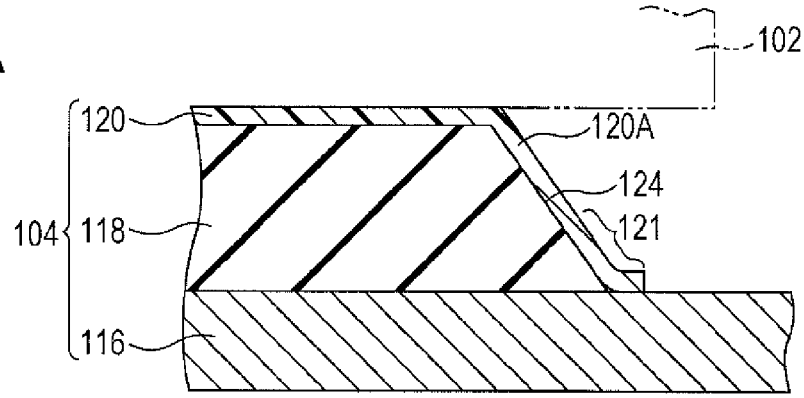
FIGS. 9A, 9B, and 9C are sectional views each illustrating part of a pressure roller according to one of modifications.

Referring to FIG. 9A, if the axial end portion 120A of the surface layer 120 of the pressure roller 104 is not restrained by the cored bar 116, the axial end portion 120A may be in contact with the cored bar 116. For example, in the configuration illustrated in FIG. 9A, a region 121 of the axial end portion 120A of the surface layer 120 is not joined to the elastic layer 118 and the cored bar 116.

Figure 9B:
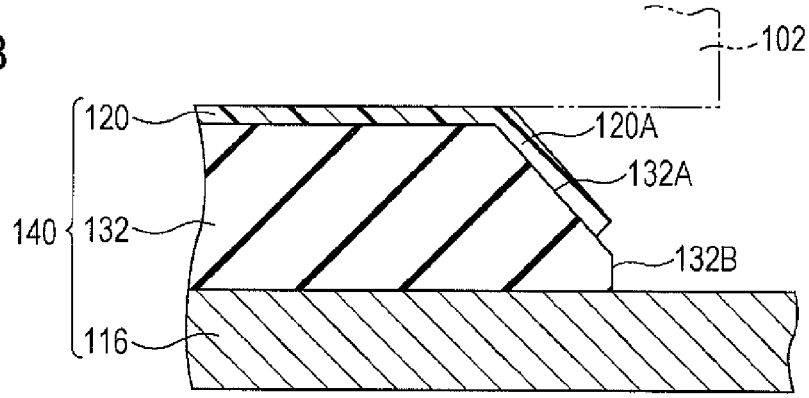

Referring now to FIG. 9B, instead of the pressure roller 104 including the elastic layer 118 (see FIG. 3B), a pressure roller 140 including an elastic layer 132 having, at each axial end thereof, a sloping end facet 132A and a vertical end facet 132B may be employed. The sloping end facet 132A, which is an exemplary sloping portion, slopes from a side thereof facing the surface layer 120. The vertical end facet 132B is continuous with the sloping end facet 132A and extends up to the cored bar 116.

Figure 9C:
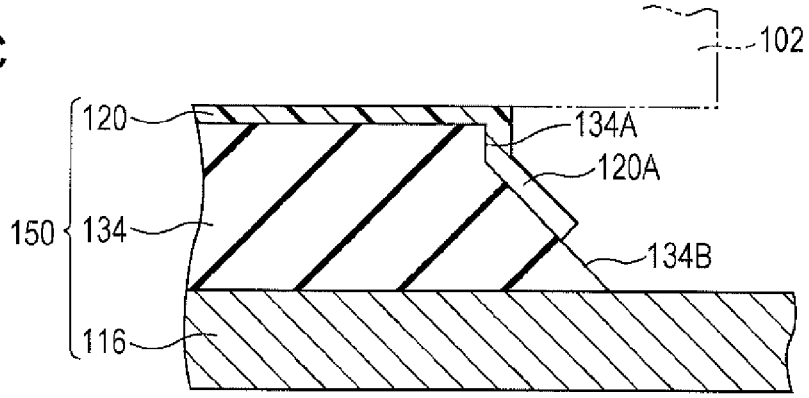

Referring now to FIG. 9C, instead of the pressure roller 104 including the elastic layer 118 (see FIG. 3B), a pressure roller 150 including an elastic layer 134 having, at each axial end thereof, a vertical end facet 134A and a sloping end facet 134B may be employed. The vertical end facet 134A extends in the direction perpendicular to the axial direction and from a side thereof facing the surface layer 120. The sloping end facet 134B, which is an exemplary sloping portion, is continuous with the vertical end facet 134A and slopes up to the cored bar 116.

The configuration in which the axial end portion 120A of the surface layer 120 extends over the sloping end facet 124 and is not restrained by the cored bar 116 is applicable to the fixing roller 102, instead of the pressure roller 104, or to both the fixing roller 102 and the pressure roller 104. The configuration in which the axial end portion 120A of the surface layer 120 extends over the sloping end facet 124 and is not restrained by the cored bar 116 is also applicable to a pressure belt or a fixing belt, instead of the pressure roller 104, or to both the pressure belt and the fixing belt. Moreover, the axial length of the fixing roller 102 may be smaller than the axial length of the surface layer 120 of the pressure roller 104.

The present invention is not limited to the above exemplary embodiment, and various modifications, changes, and improvements can be made thereto. For example, the above modifications may be combined in any way.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing member comprising:

a base member having a substantially cylindrical surface;

an elastic layer provided around the substantially cylindrical surface and having, at each axial end thereof, a sloping surface that slopes such that an outside diameter of the elastic layer is gradually reduced toward an outer side in an axial direction; and a surface layer joined to an outer circumferential surface of the elastic layer and a portion of the sloping surface and having a higher modulus of elasticity than the elastic layer, each axial end of the surface layer being free of restraint by the base member, wherein the sloping surface of the elastic layer has a length that is longer than a length of the surface layer that joins the sloping surface so that at least a portion of the sloping surface is not covered by the surface layer.

2. The fixing member according to claim 1, wherein the surface layer is spaced apart from the base member.

3. The fixing member according to claim 1, wherein, in a direction along the sloping surface, a length of a portion of the surface layer that is joined to the sloping surface is about 10% or greater and about 95% or smaller with respect to a length of the sloping surface.

4. A fixing device comprising:

a heating member configured to heat an image on a recording medium sheet; and a pressing member configured to press the recording medium sheet against the heating member, wherein at least one of the heating member and the pressing member is the fixing member according to claim 1.

5. The fixing device according to claim 4, wherein the surface layer is joined to a portion of the sloping surface that tends to elastically deform toward a plane extending in the axial direction when the pressing member is pressed against the heating member.

6. An image forming apparatus comprising:

a transfer portion where an image is transferred to a recording medium sheet; and the fixing device according to claim 4 that is configured to fix the image that has been transferred to the recording medium sheet at the transfer portion on the recording medium sheet.

7. A fixing member comprising:

a base member having a substantially cylindrical surface;

an elastic layer provided around the substantially cylindrical surface and having, at each axial end thereof, a sloping surface that slopes such that an outside diameter of the elastic layer is gradually reduced toward an outer side in an axial direction; and a surface layer joined to an outer circumferential surface of the elastic layer and a portion of the sloping surface and having a higher modulus of elasticity than the elastic layer, each axial end of the surface layer being free of restraint by the base member, wherein, in a direction along the sloping surface, a length of a portion of the surface layer that is joined to the sloping surface is about 10% or greater and about 95% or smaller with respect to a length of the sloping surface.

* * * * *